United States Patent [19]

Hodges

[11] 4,440,329

[45] Apr. 3, 1984

[54] APPARATUS FOR UNLOADING HOSIERY MACHINERY

[75] Inventor: Michael J. Hodges, High Wycombe, England

[73] Assignee: Dextomat Machinery Limited, England

[21] Appl. No.: 341,639

[22] Filed: Jan. 22, 1982

[51] Int. Cl.[3] ..... D05B 21/00

[52] U.S. Cl. ..... 223/43

[58] Field of Search ..... 223/39–43, 223/61, 63, 75–77

[56] References Cited

U.S. PATENT DOCUMENTS 2,760,697 8/1956 Shoaf ..... 223/42

FOREIGN PATENT DOCUMENTS 1501869 2/1978 United Kingdom .

1577758 10/1980 United Kingdom .

2066862 7/1981 United Kingdom .

*Primary Examiner*—Louis Rimrodt

*Attorney, Agent, or Firm*—Wellington M. Manning, Jr.; Luke J. Wilburn, Jr.

[57] ABSTRACT

A hosiery toe closer has a hollow tubular carrier, to which suction is applied for everting hosiery, and an unloading mechanism for dispensing hose in an everted state on a table or tray. The unloading mechanism is a carriage reciprocally-movable forwardly of the carrier and the carriage supports at least one hose holder engageable with a welt of a hose on the carrier, so that as the carriage moves forwardly, it pulls the hose welt along the carrier while simultaneously the hose toe is sucked into the carrier; continued movement of the carriage pulls the hose out of the carrier and discharges it in a straight, everted condition.

6 Claims, 2 Drawing Figures

APPARATUS FOR UNLOADING HOSIERY MACHINERY

The present invention relates to an apparatus and method for unloading hosiery machinery such as toe closers employed in the manufacture of hosiery, e.g. ladies stockings and mens socks.

In the course of their manufacture, hosiery articles are frequently drawn over elongated carriers such as inspection forms, from which they must ultimately be removed. Removal is usually accomplished by means of a pneumatic delivery system. Such systems can be inconvenient and noisy and may not always succeed in depositing the hosiery articles in a convenient, laid out flat condition. Moreover, pneumatic conveying systems are unable to place the hose removed thereby on hose holders or carriers of other hosiery machines e.g. gusset-inserting machines.

One present aim has been to device apparatus and method capable of removing stockings, socks or pantihose garments from e.g. a toe closing machine, and of delivering the removed articles to another location e.g. a receiving table where they are neatly deposited, or a hose holder or carrier of another hosiery machine.

Another aim has been to perform the removal while at the same time accomplishing an everting of the articles.

According to the present invention, there is provided apparatus for use in the hosiery manufacturing industry, comprising a hollow hose carrier open at at least one, forward end thereof, means for creating suction in the carrier, and a hose unloading mechanism associated with the hose carrier which in use unloads the carrier and conveys unloaded hose to a position forward thereof, the unloading mechanism including a carriage movable by a drive means towards and away from the carrier along a guide path extending forwardly of the carrier, the carriage supporting means engageable with a portion of a hose on the carrier, at a position remote from the forward end thereof, to take hold of the said portion during a forward or unloading movement of the carriage, and means for controlling the suction-creating means so as to apply suction while the said hose portion is displaced forwardly from the carrier, thereby to evert the hose during an initial stage of the unloading operation.

The carrier may be and preferably is an integral part of a toe closing machine.

The invention also provides a method of everting and dispensing hosiery, wherein the hosiery is drawn over a hollow carrier which is open at one end and in which suction can be created, a hold is taken of a portion of the carrier-mounted hosiery remote from the said one end and the said portion is moved forwardly along the carrier while suction is applied to the carrier to suck the hosiery remote from the said portion into the carrier, and the hosiery is pulled fully away from the carrier for dispensing, in an everted state, to a location forwardly of the carrier.

Figure 1:
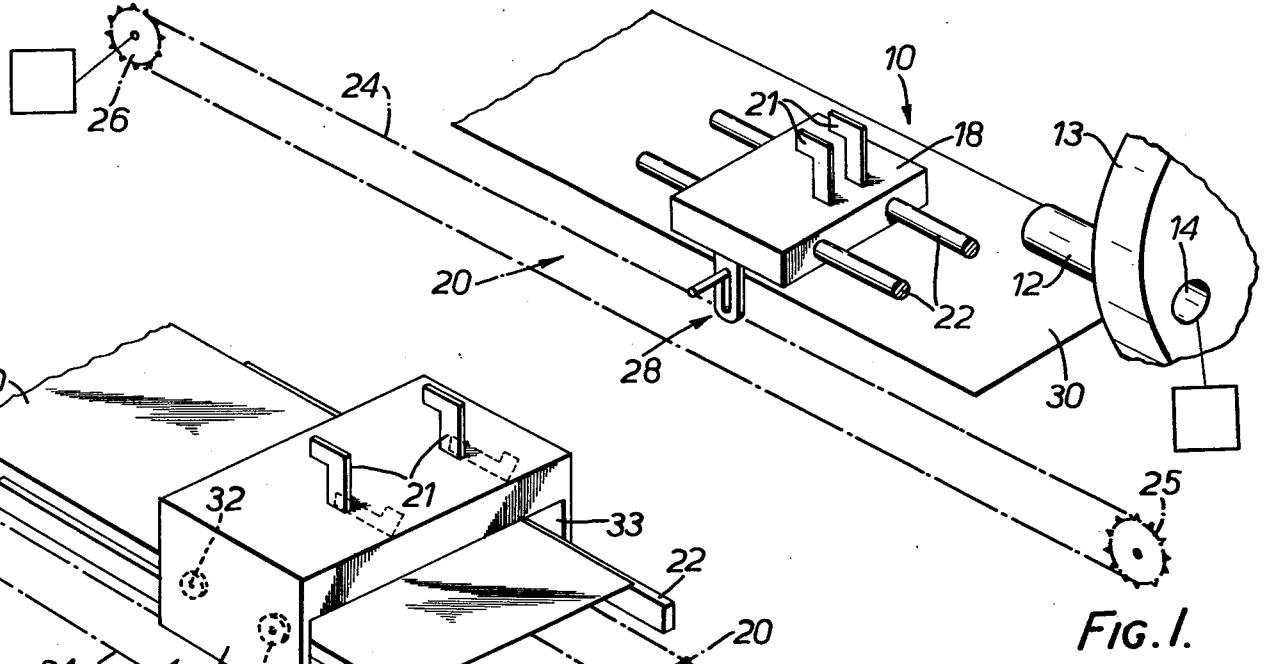
Figure 2:
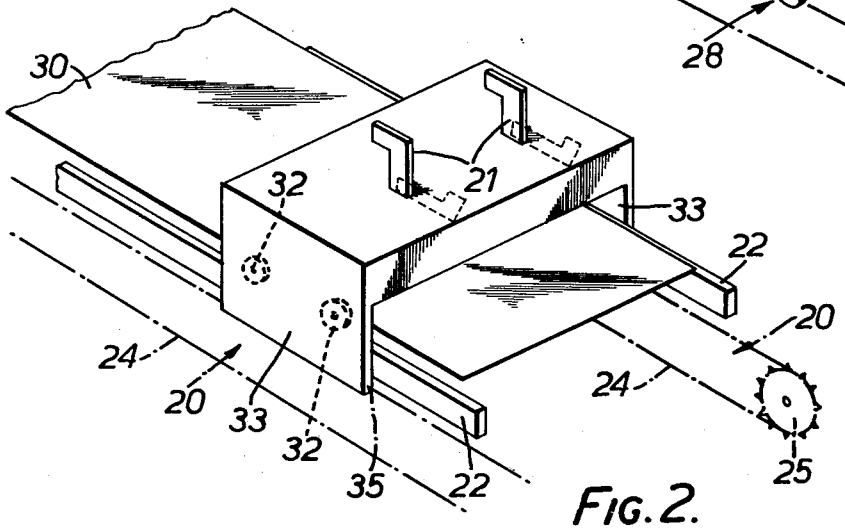

The invention will now be described by way of example only with reference to the accompanying drawings, in which:

FIG. 1 diagrammatically illustrates a toe closing apparatus according to the invention, and FIG. 2 is a similar illustration of modified apparatus according to the invention.

The apparatus 10 shown in the drawings is an automatic toe closer machine, furnished with an everter/unloader facility. The everter/unloader facility could be adapted readily to operate with other hosiery machines such as inspection machines where such machines have hollow hose carriers into which hose can be drawn during everting.

The apparatus 10 can be an automatic toe closer which operates along the lines of the Detexomat Pantimatic and Speedomatic HS machines. These machines are described in British Patent Specifications Nos. 1,501,869; 1,577,758 and 8037143, (publication No. 2,066,862) all in the name of Detexomat Machinery Limited of High Wycombe, England. In these machines, hosiery articles for toe closing are mounted on elongated, hollow leg carriers 12 which project from a movable support 13. The support is commonly a rotatable turret; each of the above Detexomat machines is of turret type. In use, hose legs are initially everted, with the aid of suction created in the leg carriers, as they are drawn lengthwise over the carriers. After accurately positioning the hose toe ends on the carriers, positioning being accomplished manually or preferably automatically, the toe ends are displaced forwardly from the carriers 12 into a movable clamp, not shown. The clamp takes hold of toe ends fed thereinto and advances them past a seamer, usually a sewing machine, which seams the toe ends closed and trims them to shape. Then, after release of the toe ends from the clamp following seaming, the toe ends are pulled back onto their carriers 12. In a complete cycle of operations of the aforementioned toe closers, their carrier-supporting turrets 13 index one revolution about their turning axes.

During each cycle of operations a stage is reached when the indexing turret 13 has positioned one carrier or a pair of carriers 12 bearing toe-seamed hose at an unloading station. The carrier 12 seen in FIG. 1 is to be understood to be at the unloading station.

Unloading is usually accomplished by sucking the toe-seamed hose toe end first into and through the carrier 12, followed by passage through an opening 14 in the turret 13 into a pneumatic conveying duct, not shown. Pneumatic systems have numerous disadvantages including noise and relatively heavy power requirements, and do not succeed always in delivering hose neatly onto a receiving table. Such systems cannot engage the hose removed from the carrier with hose holders or on carriers of other hosiery machines such as gusset-inserting machines and boarding machines. Relatively long ducts with bends would be needed if the seamed hose have to be conveyed to a gathering point in front of the turret.

The present unloading mechanism has been developed to overcome these drawbacks, and will now be described. The mechanism 16, which is located in front of the turret 13, comprises a carriage 18 and a drive 20 for moving the carriage to and fro relative to the carrier 12, in this case parallel to the lengthwise direction of carrier 12. The carriage 18 has two hose holding means 21, and is mounted for guided movement to and fro along rails 22 which extend through passages traversing the carriage 18. The hose holding means 21 can be upstanding hooks as illustrated, and can be further exemplified as grippers such as pincers for positively grasping the hose.

The drive 20 operates to move the carriage 18 reciprocally in timed relation to arrival of the carriers 12 bearing toe-seamed hose at the unloading station. The carriage could be driven continuously to and fro, although it may be preferable for it to move intermittently, resting at a convenient ready position before it is required to move to the turret 13 and then away therefrom in an unloading stroke. Conventional switching and timing means can be employed to control the operation of the motor and the movement of the carriage 18. The carriage 18 will normally be driven by an electric motor via a transmission belt or chain 24 trained around sprockets 25, 26 located adjacent and remote from the turret 13, respectively. One of the sprockets is driven by a motor of unidirectional type, the carriage being connected to the chain 24 by a lost motion coupling 28. If a reversible motor were employed, a simple anchorage for the chain 24 on the carriage will suffice, in place of the lost-motion coupling 28. Chain drive transmissions are not obligatory, and lead-screw drives, hydraulic drives and so on can be substituted.

The toe closer has the usual provision for suction everting and it is arranged that suction is created in the carrier 12 while it is at the unloading station and the carriage 18 is in the course of performing its unloading stroke.

A collecting table or tray 30 is located beneath the carriage 18, one edge of the table or tray being adjacent the turret 13. The table or tray is supported by means not shown.

The operation of the unloader will now be described. The hose for unloading is stretched along the carrier 12 with its welt end located forwardly of the turret 13 in a position enabling the holding means 21 to take hold of the hose. Upon arrival of the carrier 12 at the unloading station the carriage 18, which may already be in a hosegathering position adjacent the turret, commences its forward movement inserting the holding means 21 into the welt of the stocking. The holding means 21 can readily enter the welt if the latter is of substantially larger circumference than the carrier 12. In the aforementioned Detexomat machines, the carriers are tubes having two diametrically-projecting blades; when hosiery articles are stretched over such carriers, gaps exist between the welts and the carrier tubes, and entry of the holding means 21 into the gaps is straightforward. The carriage 18 could, alternatively, still be in the course of moving toward the turret when the carrier 12 arrives at the unloading station. Simultaneously with the holding means taking hold of the welt or shortly thereafter, controlled valve means is actuated to establish suction inside the carrier 12. The hose toe end is sucked into the carrier 12, therefore, while the holding means 21 of the forwardly-moving carriage is pushing the hose welt off the carrier. Suction can be switched off as soon as or shortly after the hose welt has left the carrier 12. As the carriage 18 continues moving to its position remote from the turret, it pulls the hose out from the carrier 12 and deposits it in a straight condition upon the underlying table or tray 30. It will be appreciated that thanks to the suction and the initial movement of the carriage 18, the hose leg is everted as it is unloaded.

The holding means 21 can be arranged to release the hose welt in several ways. Firstly, release can occur of its own accord immediately the carriage 18 commences a return movement toward the turret 13. Secondly, a stripper such as a clamping bar could be Provided, momentarily to hold the hose on the table or tray 30: while the hose is so held, the holding means 21 will slip from the welt during a final part of the forward motion of the carriage 18. Thirdly, and this may be preferred especially if the carrier 12 is arranged to reach the unloading station while the carriage 18 is still returning toward the turret, the holding means 21 may be mounted for movement between an erect, active position and a collapsed or inactive position. Release of the hose welt then would be attained by moving the holding means 21 to the inactive position. Such movable holding means could be pivoted in the carriage and movement thereof between the active and inactive positions could be controlled by tripping means such as cams mounted on or beneath the rails 22.

As mentioned above, the holding means could be pincers operable in any convenient manner to release the hose welt.

The unloader shown in FIG. 1 is of very simple construction and can unload two carriers 12 simultaneously, but it may be somewhat inconvenient in having the rails 22 located above the table or tray 30. The modification shown in FIG. 2 may be preferred, particularly where two carriers 12 are to be unloaded simultaneously as would be appropriate when unloading a Detexomat Pantimatic or Detexomat Speedomatic HS toe closer.

In FIG. 2, the carriage 18 is appreciably wider than in the previous embodiment, and runs on straight rails 22 located one to either side of the table or tray 30. Smooth running is assured thanks to rail-engaging rollers 32 journalled in depending wings 33 of the carriage. In this embodiment the drive 20 comprises two identical chains 24 each anchored at its ends, at 35, to the carriage wings 33. The motor suitable for driving this embodiment is therefore of reversible type. A unidirectional motor could of course be used if the drive 20 is connected to the carriage 18 by a lost motion coupling.

The FIG. 2 embodiment is particularly but not exclusively suitable for unloading pantihose garments from the twin carriers of pantihose machines such as the Detexomat Pantimatic.

The apparatus 10 disclosed above comprises a toe closer. The unloading/everting facility can be applied to other apparatus, used in the hosiery manufacturing industry, which employs hollow, open-ended carriers to which everting suction can be applied. Examples of such apparatus are hosiery inspection devices and seam straighteners.

As described and illustrated, the apparatus 10 dispenses hose onto a table or tray. The invention is not limited to dispensing in this manner and the apparatus can be used to evert and transfer hose from suction-type carriers of one hosiery machine to a hose holder or carrier of another hosiery machine such as a gusset-inserting machine and a boarding machine. In some cases it may be required to transfer hose from the suction-type carriers into a roller nip (for example to press and/or heat set the hose); the apparatus 10 can readily be arranged to accomplish this.

I claim:

1. Apparatus for use in the hosiery manufacturing industry, comprising a hollow hose carrier open at at least one, forward end thereof, means for creating suction in the carrier, and a hose unloading mechanism associated with the carrier and operable to unload said carrier and to convey unloaded hose to a position forward thereof; said unloading mechanism including: a movable carriage, drive means to move said carrier to and fro along a guide path extending forwardly thereof, means supported by said carrier and operable at a position remote from the forward end of said carrier to take hold of a portion of a hose thereon during a forward or unloading movement of said carriage; and means for controlling said suction-creating means whereby suction is applied while said hose portion is displaced forwardly of said carrier, to evert the hose during an initial stage of the unloading operation.

2. Apparatus according to claim 1, which comprises a hosiery toe closer of which the carrier is an integral part.

3. Apparatus according to claim 1 wherein a receiving means is supported beneath said carriage to collect hose unloaded from said carrier, and two straight guide rails located one to either side of said receiving means serve to guide the carriage as it moves.

4. Apparatus according to claim 1, wherein the means which take hold of the hose comprise an upstanding hooked element on said carriage for entering a welt end of a hose on said carrier.

5. Apparatus according to claim 4, wherein said hooked element is mounted on the carriage for movement between an erect, hose-engaging position and an inactive, hose-releasing position.

6. Apparatus according to claim 1, wherein said drive means comprises a motor and a drive transmission loop coupled to said carriage, the motor is of unidirectional type and a lost motion coupling connects the loop to the carriage.

* * * * *

UNITED STATES PATENT AND TRADEMARK OFFICE

CERTIFICATE OF CORRECTION

PATENT NO. : 4,440,329
DATED : April 3, 1984
INVENTOR(S) : Michael J. Hodges

It is certified that error appears in the above-identified patent and that said Letters Patent are hereby corrected as shown below:

At section [30] on the Title page of the patent please insert: -- Foreign Application Priority Data January 23, 1981 [GB] United Kingdom .....8102162--.

Signed and Sealed this

*Thirteenth* Day of *November 1984*

[SEAL]

*Attest:*

GERALD J. MOSSINGHOFF

*Attesting Officer*

*Commissioner of Patents and Trademarks*